US007677391B2

(12) United States Patent
Pistor et al.

(10) Patent No.: US 7,677,391 B2
(45) Date of Patent: Mar. 16, 2010

(54) STORAGE DEVICE FOR TOOLS, ESPECIALLY SCREWDRIVER BITS

(75) Inventors: Oliver Pistor, Wuppertal (DE); Ralf-Richard Richter, Wuppertal (DE)

(73) Assignee: Wera Werk Hermann Werner GmbH & Co. KG (DE)

( * ) Notice: Subject to any disclaimer, the term of this patent is extended or adjusted under 35 U.S.C. 154(b) by 0 days.

(21) Appl. No.: 12/471,123

(22) Filed: May 22, 2009

(65) Prior Publication Data

US 2009/0288974 A1 Nov. 26, 2009

Related U.S. Application Data

(63) Continuation of application No. PCT/EP2007/061381, filed on Oct. 24, 2007.

(30) Foreign Application Priority Data

Nov. 23, 2006 (DE) ..... 10 2006 055 195

(51) Int. Cl.
*B65D 85/28* (2006.01)

(52) U.S. Cl. ..... 206/379; 206/372

(58) Field of Classification Search ..... 312/309–311; 211/70.6; 206/762, 759, 752, 379, 378, 372
See application file for complete search history.

(56) References Cited

U.S. PATENT DOCUMENTS 5,512,165 A 4/1996 Liu

FOREIGN PATENT DOCUMENTS

| | | | |
|---|---|---|---|
| DE | 8812791 | U1 | 11/1988 |
| DE | 9416462 | U1 | 2/1995 |
| DE | 29606201 | U1 | 6/1996 |
| DE | 29710218 | U1 | 7/1997 |
| DE | 19620566 | A1 | 11/1997 |
| DE | 29902062 | U1 | 12/1999 |
| DE | 20315964 | U1 | 12/2003 |
| DE | 202005020132 | U1 | 2/2006 |

OTHER PUBLICATIONS

International Search Report and Written Opinion of the International Searching Authority; PCT/EP2007/061381; Feb. 5, 2009; 11 pages.

*Primary Examiner*—Stephen Garbe
*Assistant Examiner*—Kaushikkumar Desai
(74) *Attorney, Agent, or Firm*—St. Onge Steward Johnston & Reens LLC

(57) ABSTRACT

A storage device for tools comprising a basic housing that is provided with a swiveling-in space for a pivotable part which is hinged to the basic housing so as to be pivotable from a storage position into a removal position. The pivotable part encompasses retaining openings for tool retaining arranged in a first row and extend into a tool accommodating compartment in the storage position. At least one additional row of retaining openings is provided that runs parallel to the first row. The retaining openings of the first and the at least one additional row are offset relative to one another in a zigzag-shaped manner.

17 Claims, 9 Drawing Sheets

VI
VII
V
3
2'
5
27
7
18
19
21
23
1'
1
2

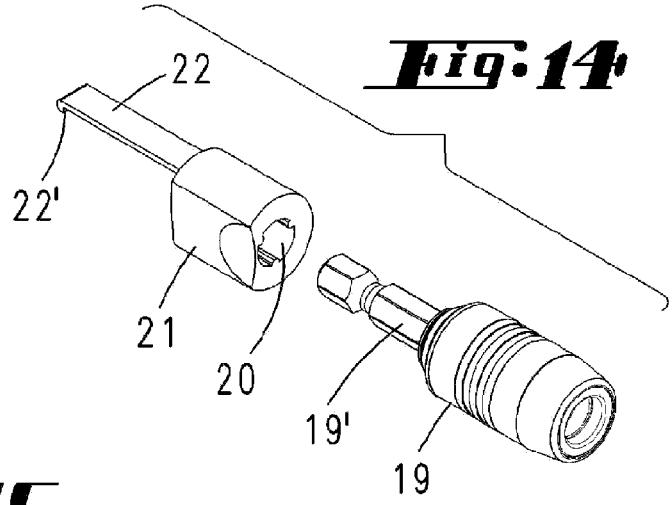
Fig. 14
Fig. 15
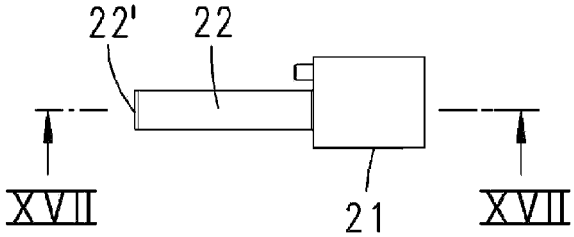
Fig. 16
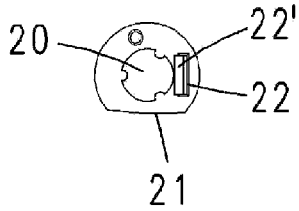
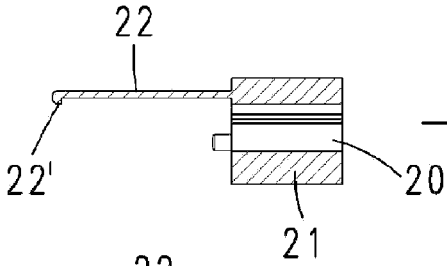
Fig. 17
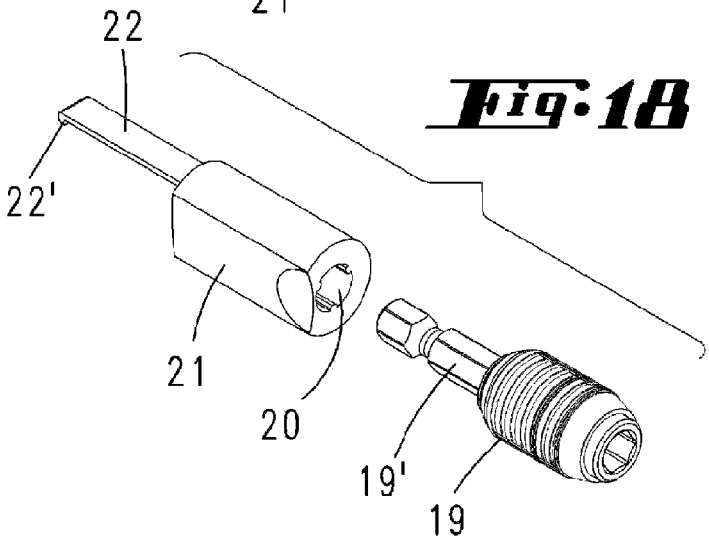
Fig. 18

STORAGE DEVICE FOR TOOLS, ESPECIALLY SCREWDRIVER BITS

CROSS-REFERENCE TO RELATED APPLICATIONS

The present application is a continuation of pending International patent application PCT/EP2007/061381 filed on Oct. 24, 2007 which designates the United States and claims priority from German patent application 102006055195.8 filed on Nov. 23, 2006, the content of which is incorporated herein by reference.

FIELD OF THE INVENTION

The invention relates to a storage device for tools, especially screwdriver bits or the like, comprising a basic housing piece that is provided with a swiveling-in space for a pivotable part which is hinged to the basic housing piece so as to be pivotable from a storage position, in which the pivotable part is inserted in the swiveling-in space, into a removal position, in which the pivotable part is swiveled out of the swiveling-in space about a swiveling axis. The pivotable part encompasses retaining openings for tool retaining sections. Said retaining openings are arranged in a first row and extend into a tool accommodating compartment in the storage position, said tool accommodating compartment adjoining the swiveling-in space. At least one additional row of retaining openings is provided that runs parallel to the first row. The retaining openings of the first and the second row are offset relative to one another within intermediate gaps and have a substantially hexagonal cross-section. The external wall of the retaining openings of the pivotable part and the external wall of the retaining openings of the pivotable strip both extend in a zigzag-shaped manner. The external wall of the retaining openings of the pivotable part faces the pivotable strip while the external wall of the retaining openings of the pivotable strip faces the pivotable part.

BACKGROUND OF THE INVENTION

Patent DE 203 15 964 U1 discloses a tool kit with a basic housing piece and a cover piece. The basic housing piece can be pivoted with the cover piece. The cover piece is hinged to the basic housing piece so that it can move by pivoting. Two pivotable parts situated in the opening of the basic housing piece are linked with one another by a coupling stud and, when the cover pivots upward, are converted from a storage position to a removal position. The front side of each pivotable part has a row of retaining openings into each of which a bit is inserted. On an L-shaped shoulder of the pivotable part, a pivotable strip is formed. Said strip can rotate by a small angle with respect to the pivotable part and likewise has retaining openings on its front side in which bits are inserted. In the storage position, the pivotable strip and pivotable part are positioned close to one another.

A storage device for six bits with related lining is disclosed in DE 196 20 566 A1. This device has a housing piece of synthetic material that is essentially U-shaped. The U-leg intermediate space forms a vacant area in which a pivotable part resides, filling the space entirely. The housing pivotable part is positioned to rotate around a swiveling axis that passes through the ends of the U-leg so that it can rotate on the basic housing piece from a storage position to a removal position. In the storage position the ends of the bits, extending from the narrowing end of the wall of the housing pivotable part, extend into a tool storage area. The bits can be seen, handled, but not removed from the storage position. The housing pivotable part, in addition, has a reception compartment for a lining, which likewise can be seen in the storage position but cannot be removed.

Patent DE 94 16 462 discloses a storage device for bits with accompanying liner, in which the bits are arranged in individual compartments which are closed by a folding lid.

U.S. Pat. No. 5,512,165 discloses a storage device for bits in which a U-shaped bracket holds a number of pivotable strips together and bits are contained in each strip.

Patent DE 88 12 791 discloses a storage device for spiral drills with a basic housing piece and a cover piece, where several pivotable strips are mounted on the cover piece and the spiral drills are housed in said strips.

It is the object of this invention to increase the range of applications of a generic storage device.

SUMMARY OF THE INVENTION

This object is achieved through the invention as indicated in the patent claims, where each claim depicts an independent fulfillment of the object and can be combined with every other claim in any form whatsoever.

First and most essentially, the object is fulfilled in that the retaining openings of the first and second rows are offset from one another by gaps, the outer wall of the basically hexagonal-cross-section retaining openings of the pivotable part that face the pivotable strip and the outer wall of the basically hexagonal-cross-section retaining openings of the pivotable strip both extend in a zigzag manner, and the zigzag protrusions of the one outer wall engage with the zigzag recesses of the other outer wall. The retaining openings both of the pivotable part and of the pivotable strip are hexagonal in cross-section, so that the hexagonal sections of the bits can be inserted there only in a predetermined alignment. The bits of the two rows, which are offset by a gap to one another, are oriented in such a way that the zigzag sections of the multi-edged surfaces, which define contiguous surfaces, of the hexagonal sections of the bits run parallel to one another in diagonal juxtaposition. The retaining openings of the bits are bounded by thin lateral walls. The outer walls of the side walls here follow the orientation of the hexagonal surfaces and form a zigzagging line. As a result of the offsetting of the bits of the two rows, rows of zigzag-running lines are formed at a distance from one another that also engage with one another. Unlike the device disclosed in DE 196 20 566 A1, the bits now not only are situated alongside one another in the tool reception area, but also align behind one another. The second row is arranged on a pivotable strip, which in the storage position is contiguous with the pivotable strip. Consequently the storage device has a narrow, slender structure. In the removal position the pivotable strip can pivot out to a pivot distance position from the pivotable part. For this purpose a jointed axis is provided which preferably extends parallel to the swiveling axis around which the pivotable part associated with the basic housing piece is positioned to pivot. The pivotable strip preferable sits in an L-cross-section opening of the pivotable part. The pivotable strip swivels outward in the opposite direction from the swiveling direction of the pivotable part. It is retained by studs in the closed position in a storage position on the pivotable part. A stud can be configured by the outer walls of the basically hexagonal-cross-section retaining openings of the pivotable strip. The counter-abutment face can be formed by the edge area of a closed rear wall of the tool storage area. The pivotable part has a first row of retaining openings for the bits. The outer walls of these retaining openings extend in zigzag shape. They follow the hexagonal course of the hexagonal sections of the bits. These outer walls of the retaining openings form a counter-abutment face. The outer walls of the retaining openings of the pivotable strip also run a zigzag-shaped course, so that here too the individual surface sections are defined by the hexagonal inner surfaces of the retaining openings. This counter-abutment face is adapted to match the abutment face of the pivotable strip. The bits of the second row, which are associated with the pivotable strip, lie at gaps to one another with the bits of the first row, which are associated with the pivotable part. The swiveling axis of the pivotable part and swiveling axis of the pivotable strip extend basically parallel to one another. The swiveling-in space is open toward the front broadside of the basic housing piece and to the rear broadside of the basic housing piece. The broad sides of the closed housing are therefore at least partly configured by the broad sides of the pivotable part. The pivotable part is basically of equal thickness with the basic housing piece. In the storage position the tool reception area is closed even to the viewing surface. It thus forms a five-sided closed hollow space. One lateral wall of this hollow space is formed by the narrow lateral surface of the pivotable part or the pivotable strip. The retaining openings both of the pivotable strip and of the pivotable part extend parallel to one another. But they run diagonally to the swiveling axis of the basic housing part or to the swiveling axis of the pivotable strip. The swiveling axis of the pivotable strip is situated about midway between the two longitudinal narrow sides of the pivotable part. For better visibility of the bits situated behind the first row in the storage position, the edges of the retaining openings of the pivotable strip extend beyond the edges of the retaining openings of the pivotable part. The result is a step.

In addition, the invention relates to a storage device for tools, in particular for screwdriver bits or the like, having a basic housing piece. Said piece can comprise a swiveling-in space for a pivotable part which is hinged to the basic housing piece so as to be pivotable from a storage position, in which the pivotable part is inserted in the swiveling-in space, into a removal position, in which the pivotable part is swiveled out of the swiveling-in space about a swiveling axis, so that the pivotable part comprises retaining openings arranged in a row for tool retaining sections. Essential here is the configuration with an accommodating chamber for a casing, which chamber is open to a broad side of the housing and comprises a insertion opening for an insertion shaft of the casing, where in the removal position the accommodating chamber is open to the side opposite the insertion opening and in the storage position is closed.

In order to enlarge the range of applications of the storage device, this device is modified in such a way that the axial length of the storage chamber, with respect to the direction of extension of the insertion shaft, is shortened by a filler piece that protrudes in the accommodating chamber. One model of the storage device can thus be outfitted with a casing of various structural length. If a shorter casing is used, the unneeded space in the accommodating chamber is replaced by a filler piece. This filler piece can also take the form of a partial section of the insertion openings for the insertion shaft of the casing. The filler piece can be fixed in place in the accommodating chamber in the manner of a catch-form lock. The accommodating chamber can have undercuttings. The result is that the filler piece can be inserted only from the front-end opening that is accessible in the removal position. For purposes of catch-locking, a catching arm is configured to match the filler piece and has on its free end a catching hook that can be moved in a catching rear-grip to a catching step of the pivotable part. As elsewhere in the art, here too an insertion opening can extend parallel to the swiveling axis of the housing, while the accommodating chamber is closed in the storage position by a section of the basic housing piece and the basic housing piece is U-shaped.

A modification of the invention foresees that the basic housing piece comprises a belt buckle. The housing can be secured to a belt by means of this belt buckle.

Embodiments of the invention are described hereafter with reference to appended illustrations.

BRIEF DESCRIPTION OF THE DRAWINGS

FIG. 14 shows in perspective view a casing with a filler piece.

FIG. 15 shows the filler piece in overhead view.

FIG. 16 shows the filler piece in side view.

FIG. 17 shows a sectional view along the line XV-XV in FIG. 13.

FIG. 18 shows a perspective depiction of a longer filler piece.

DETAILED DESCRIPTION OF THE INVENTION

Figure 1:
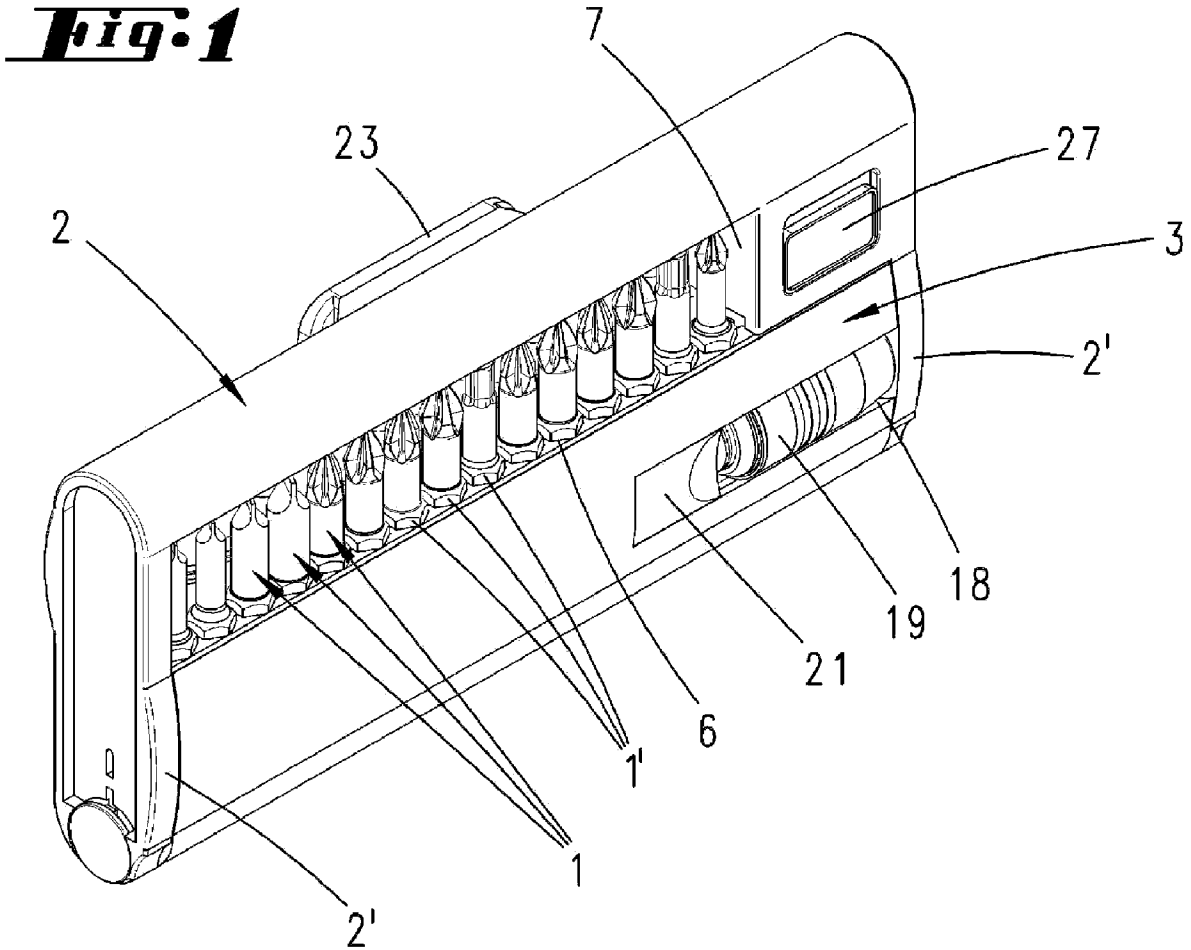
FIG. 1 shows the closed storage device in a perspective view.
Figures 2, 3:
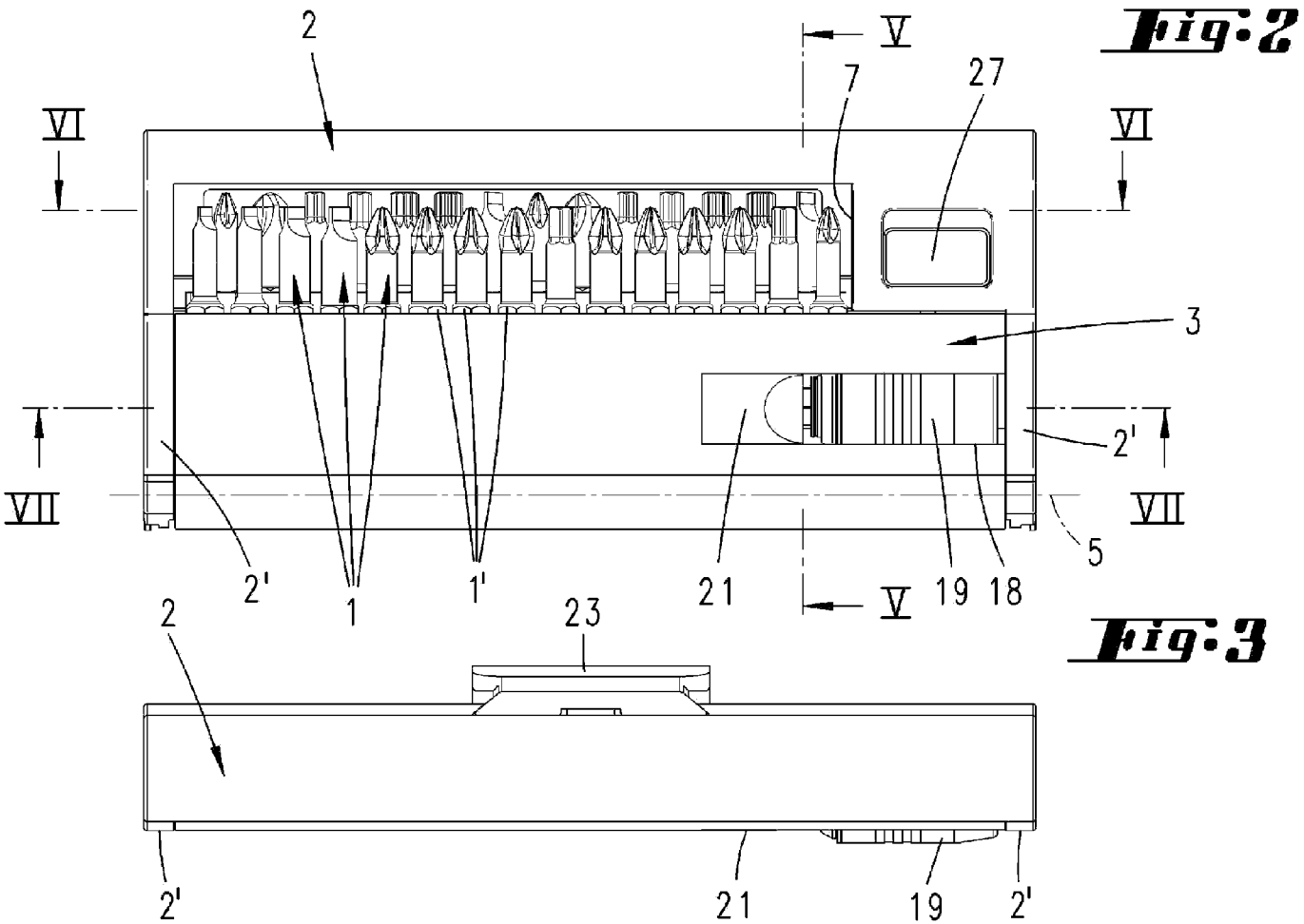
FIG. 2 shows a broad-side view of the closed device.
FIG. 3 shows an underneath view of the device in closed condition.
Figure 5:
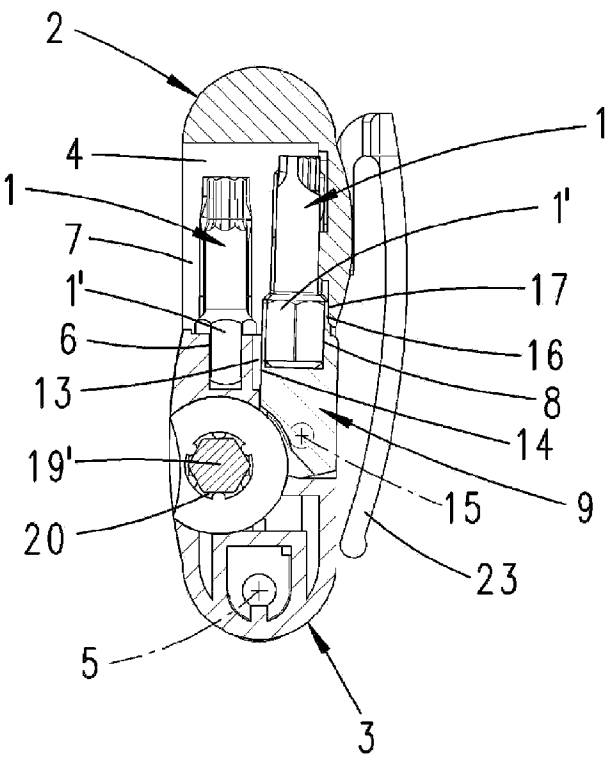
FIG. 5 shows a sectional view along the line V-V in FIG. 2.
Figure 4:
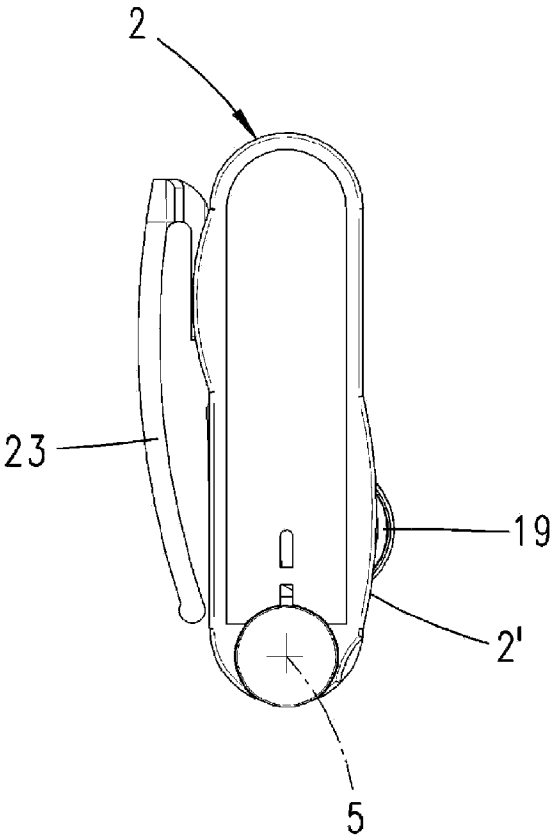
FIG. 4 shows a side view of the device in closed position.

The storage device consists of several parts made of plastic. It serves to accommodate screwdriver bits 1 of steel construction, which comprise diversely shaped working points and uniformly designed hexagonal sections I1.

A basic housing piece 2 has a basically U-shaped base design. Between the two U-legs 2 1, there extends a swiveling-in space 4 for a pivotable part 3 that is open to the front and rear. This pivotable part 3 completely fills up the swiveling-in space 4 in the storage position as illustrated in FIGS. 1-7.

The pivotable part 3 is associated with the swiveling-in space 4 in such a way that it can swivel around a swiveling axis 5. The swiveling axis 5 extends through the two free ends of the U-leg T. The narrow side of the pivotable part 3 that runs parallel to the swiveling axis 5 has a first row of retaining openings 6. These retaining openings 6 extend parallel to the edge between the narrow side and the broad-side surface of the pivotable part 3 and extend into a tool accommodating compartment 7, which is associated with the basic housing piece 2 and which adjoins the swiveling-in space 4. The tool accommodating compartment 7 has a rear wall T.

Extending behind the first row of retaining openings 6 is a second row of retaining openings 8, which also have a hexagonal cross-section, so that the hexagonal sections I1 of the screwdriver bits 1 can be inserted therein. The retaining openings 8 of the second row are associated with a pivotable strip 9. The back side of the pivotable part 3 has a recess 12 to accommodate the pivotable strip 9. Said recess 12 has walls in an L-shaped arrangement. In the storage position an abutment face 13 of the pivotable part 3 is contiguous with a counter-abutment face 14 of the pivotable strip 9. The abutment face 12 and the counter-abutment face 14 extend in zigzag shaped lines. Both the counter-abutment face 14 and the abutment face 13 are configured by the outer walls of the associated retaining openings 6, 8. Here protuberances of the abutment face 13 engage in recesses in the counter-abutment face 14 and vice versa. The retaining openings 6 of the front first row are offset by gaps from the retaining openings 8 of the rear second row. Thus the screwdriver bits 1 extending into the rear retaining openings 8 can be discerned through the gaps of the screwdriver bits 1 extending in the front retaining openings 6. The distance between the rows is minimal and less than the lateral dimension of the retaining openings 6, 7.

The apertures of the retaining openings 8, in addition, are at a great distance from the swiveling axis 5 than the opening apertures of the front retaining openings 6, so that the rear bits 1 extend above the front row of bits 1.

Figure 11:
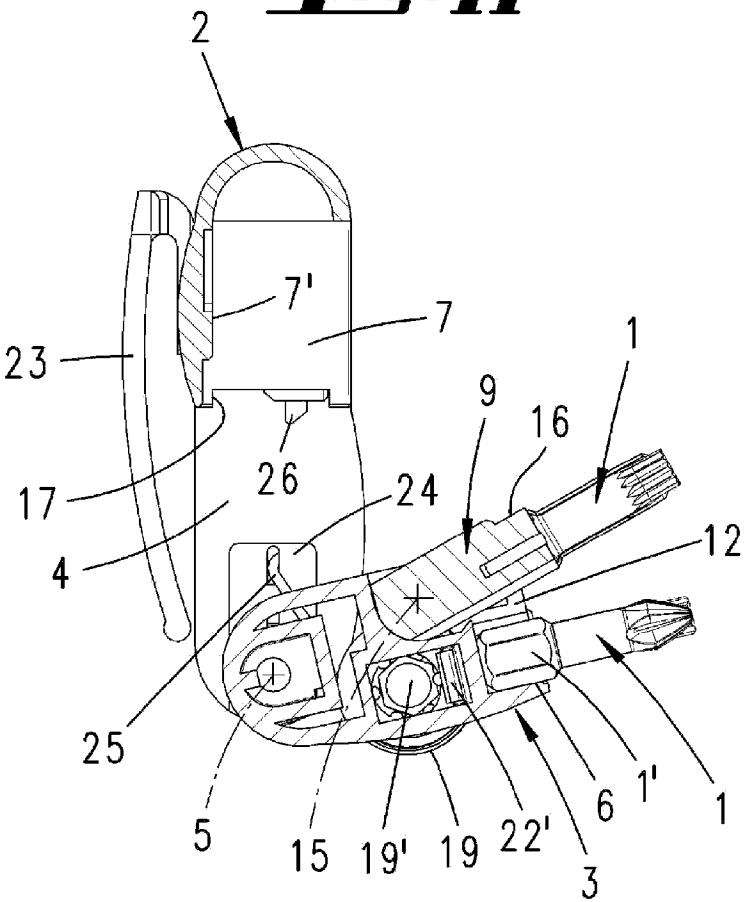
FIG. 11 shows a sectional view along the line XI-XI in FIG. 9.
Figure 10:
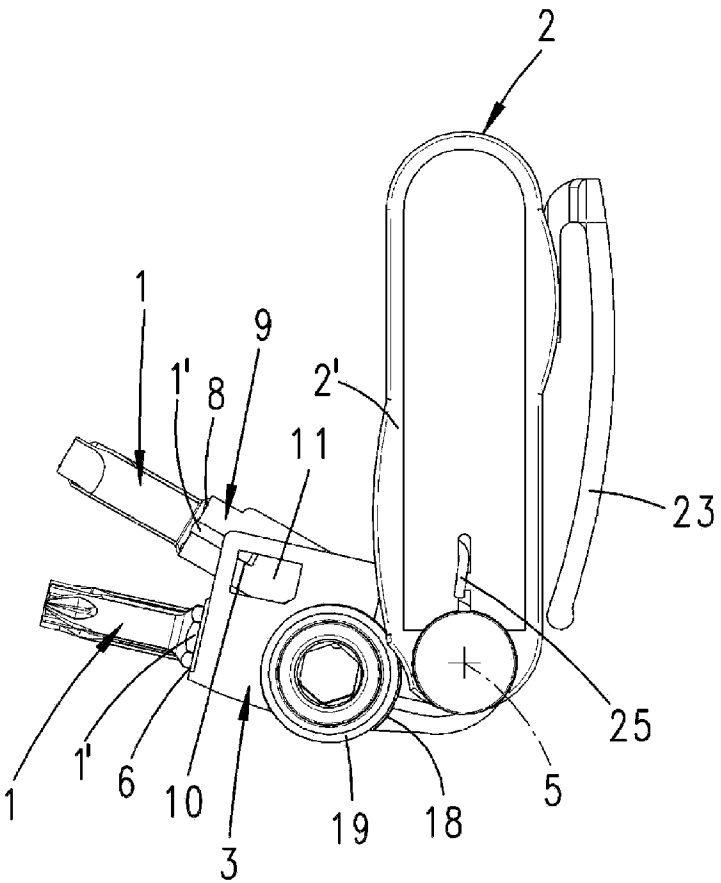
FIG. 10 shows a side view of the device in the removal position.

While the bits of the front and rear rows extend parallel to one another in the storage position, in the removal position they assume an inclined position with respect to one another, as shown in FIGS. 10 and 11. This is a result of a swiveling connection of the pivotable strip 9 to the pivotable part 3. The pivotable strip 9 can pivot about a swiveling axis 15. A pivotable abutment is formed by the aforementioned abutment faces 13, 14. A second pivotable abutment, corresponding to the swiveled-out position, is formed by an abutment protrusion 10, which is associated with the pivotable strip 9 and extends into a window 11 of a wall of the recess 12. In the swivel position the shafts of the screwdriver bits of the various rows are spaced apart from one another in such a way that the shafts of the bits 1 can be comfortably grasped by two fingers of the hand.

The rear wall T of the tool accommodating compartment 7 has an edge that extends into the swiveling-in space 4 and forms a counterabutment face 17. Upon swiveling-in the pivotable part 3 from the removal position shown in FIGS. 10 and 11 to the storage position shown in corresponding FIGS. 4 and 5, an abutment face 16 of the back of the pivotable strip 9 acts on the counterabutment face 17, so that the pivotable strip 9 is swiveled into the abutment face. The abutment face 16 extends close to the narrow lateral wall of the pivotable strip 9 that forms the retaining openings 8. As already mentioned, this narrow lateral wall, in conjunction with the narrow lateral wall of the pivotable part 3 that forms the retaining openings 6, forms a step.

A torsion spring 25 is provided which is positioned in a spring-loaded bearing 24 of the basic housing piece 2. The spring-loaded bearing 24 is associated with a U-leg of the basic housing piece 2 and with its opening indicates the swiveling-in space 4. This torsion spring 25 drives the pivotable part 3 into the removal position. In addition to the tool accommodating compartment 7, the broad-side surface of the basic housing piece 2 also has a lock bolt 27. With this lock bolt a latch bolt 26 can be drawn back. In the storage position this latch bolt 26, which extends into the swiveling-in space 4, is impacted by a spring and driven into a bolt insert opening 28 of the pivotable part 3. As a result the pivotable part is locked in the storage position. A belt-retaining strap 23 is affixed on the rear 7 1 of the tool accommodating compartment 7. The belt-retaining strap 23 extends in some areas beyond the rear of the swiveling-in space 4.

Between the narrow wall of the housing that forms the retaining openings 6 and the swiveling axis 5 there is an accommodating chamber 18 for a casing 19, said chamber in the embodiment being closed at the rear but open in front. The casing 19 has a hexagonal shaft 19', with which it can be inserted into the casing of a cordless screwdriver or the like. The accommodating chamber 18 is of length L. If the casing has a head that corresponds to the length L of the accommodating chamber 18, then the casing 19 fills up the accommodating chamber 18 completely. The hexagonal shaft 19' in this case is situated in an insertion opening 20.

If the storage device is intended to be equipped with a casing whose length L 1 is less than the length L of the accommodating chamber 18, then a filler piece 21 is inserted into the accommodating chamber 18 from the front end. The cross-section contour of the filler piece 21 in this case corresponds to the cross-section contour of the accommodating chamber 28. The front section of the filler piece 2 is configured in such a way that it is situated flush in the outer surface of the pivotable part 3. Extending beyond the filler piece 21 is a catch-arm 22, whose length corresponds approximately to the length of the hexagonal section 19'. Situated on the free end of the catch-arm 22 is a catch-hook 22', which in the inserted position snaps around a counter-catch of the pivotable part 3, so that the filler piece 21 is form-locked in place.

The front end of the accommodating chamber 18 in the swiveled-in position is closed off by a U-leg 2 1 of the basic housing part 2. The casing can be withdrawn from the accommodating chamber 18 only in the removal position. A total of twenty-nine insertion openings 6, 8 are depicted in the embodiment. A total of fifteen insertion openings are associated with the pivotable part 3. Another fourteen insertion openings are associated with the pivotable strip 9 that is pivotally jointed to the pivotable part 3 about a swiveling axis 15. The pivotable strip 9 can also have fifteen insertion openings in order to accommodate a thirty-part set of bits in the storage device.

Figure 13:
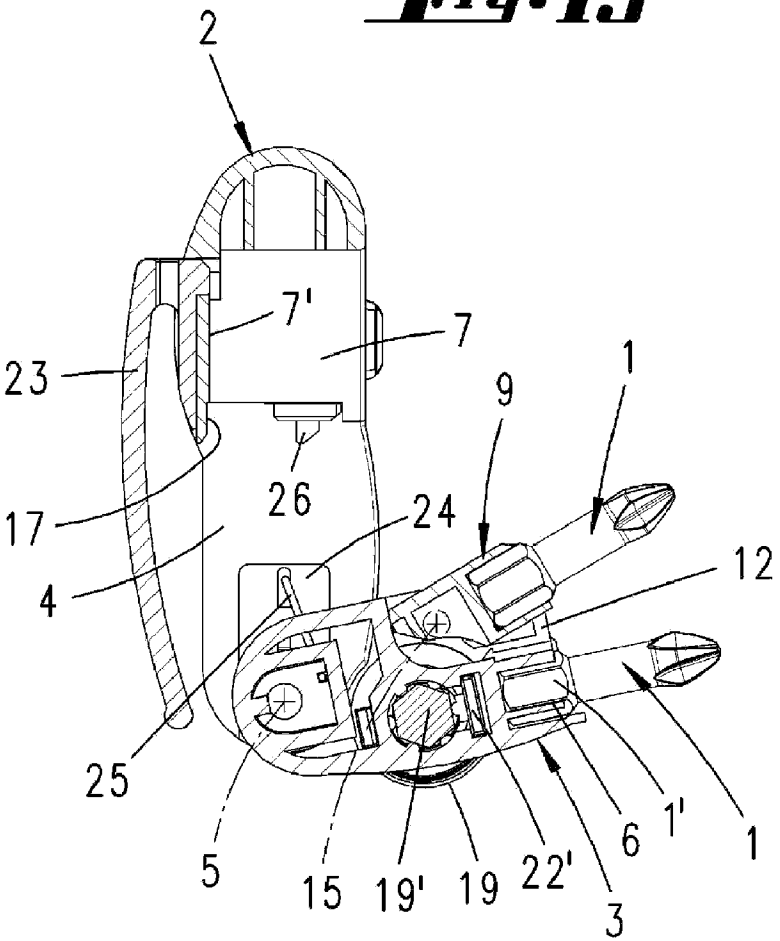
FIG. 13 shows a depiction according to FIG. 11 of a second embodiment.
Figure 12:
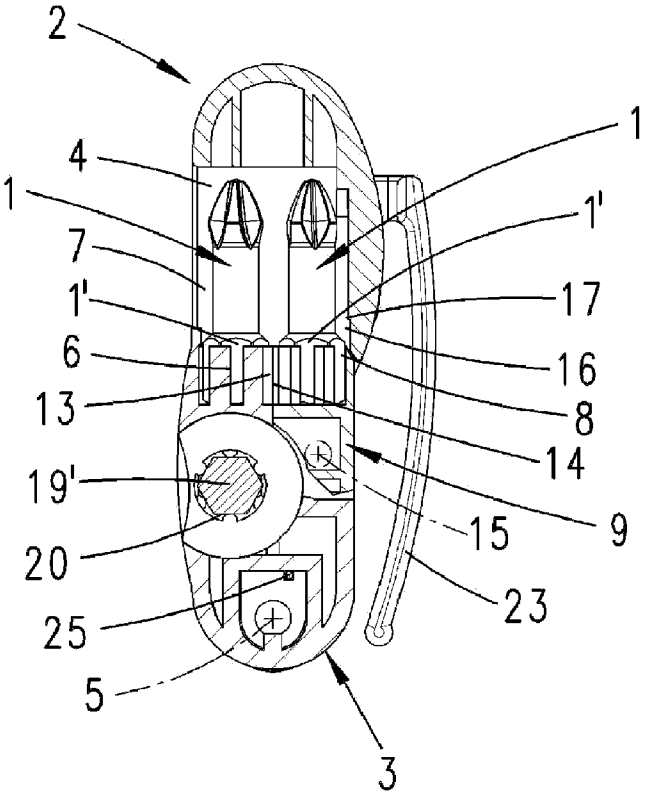
FIG. 12 shows a depiction according to FIG. 5 of a second embodiment.

The second embodiment, shown in FIGS. 12 and 13, basically departs from the first embodiment only concerning the design of the belt strap 23 and of the pivotable strip 9. The belt strap 23 in this case is situated somewhat deeper, but is also connected with the basic housing piece 2 by a form-locking clip connection.

Unlike in the first embodiment, the pivotable strip 9 has a somewhat shorter configuration in the embodiment shown in FIGS. 12 and 13. As can be seen in particular from FIG. 12, the narrow side of the pivotable strip 9 is situated at the same height as the edge of the retaining openings 6 of the pivotable part 3. The rows of retaining openings 6 situated behind one another thus have edges that lie in a common plane. In this variant the bits 1 situated front-most are not exceeded in length by the bits 1 in the rear.

Figure 6:
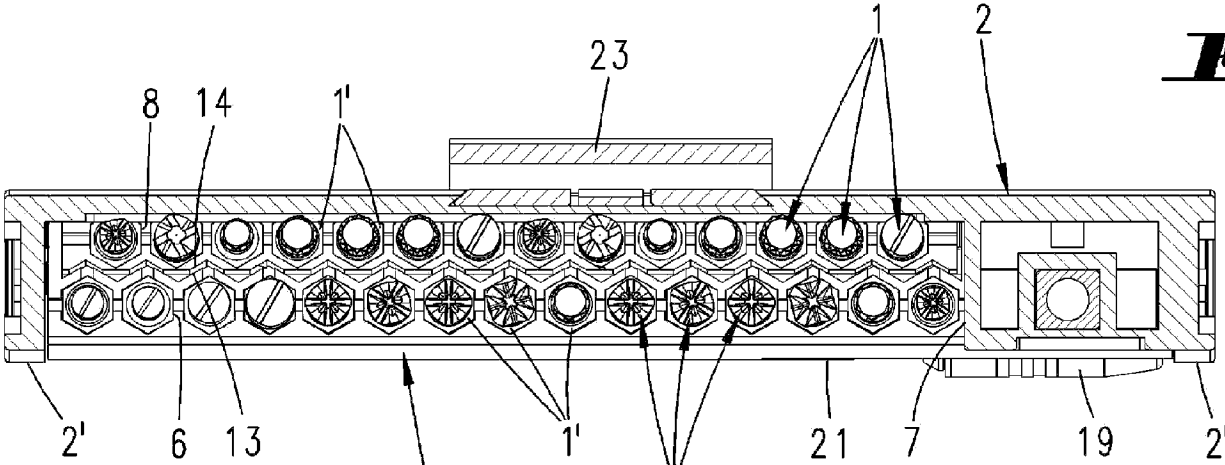
FIG. 6 shows a sectional view along the line VI-VI in FIG. 2.
Figure 7:
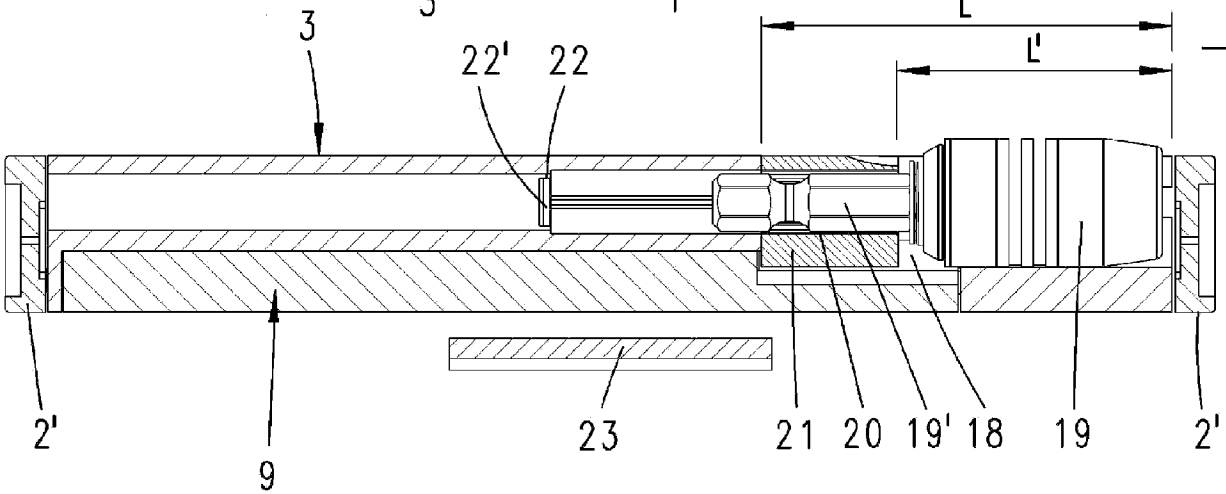
FIG. 7 shows a sectional view along the line VII-VII in FIG. 2.
Figure 8:
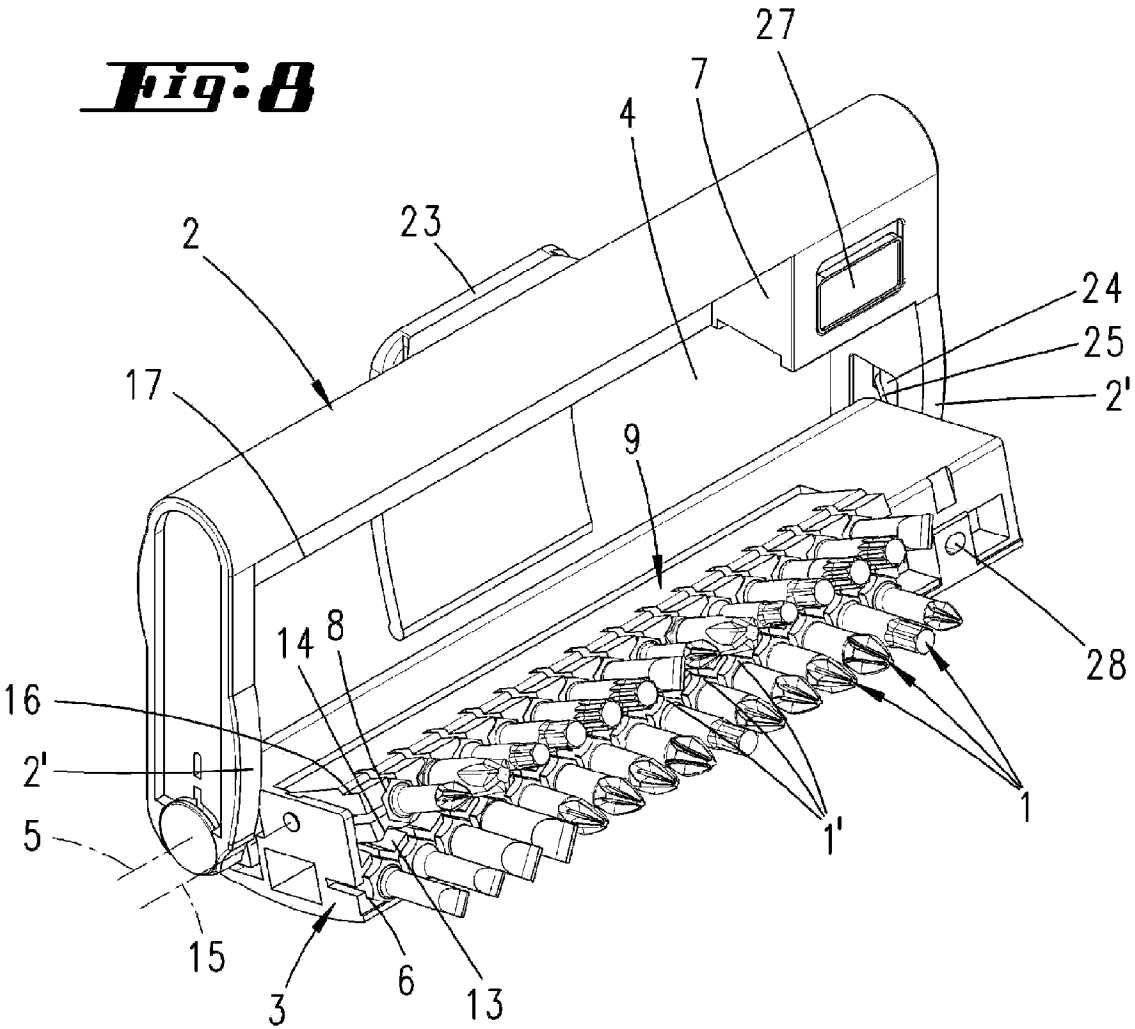
FIG. 8 shows a depiction according to FIG. 1 in the removal position.
Figure 9:
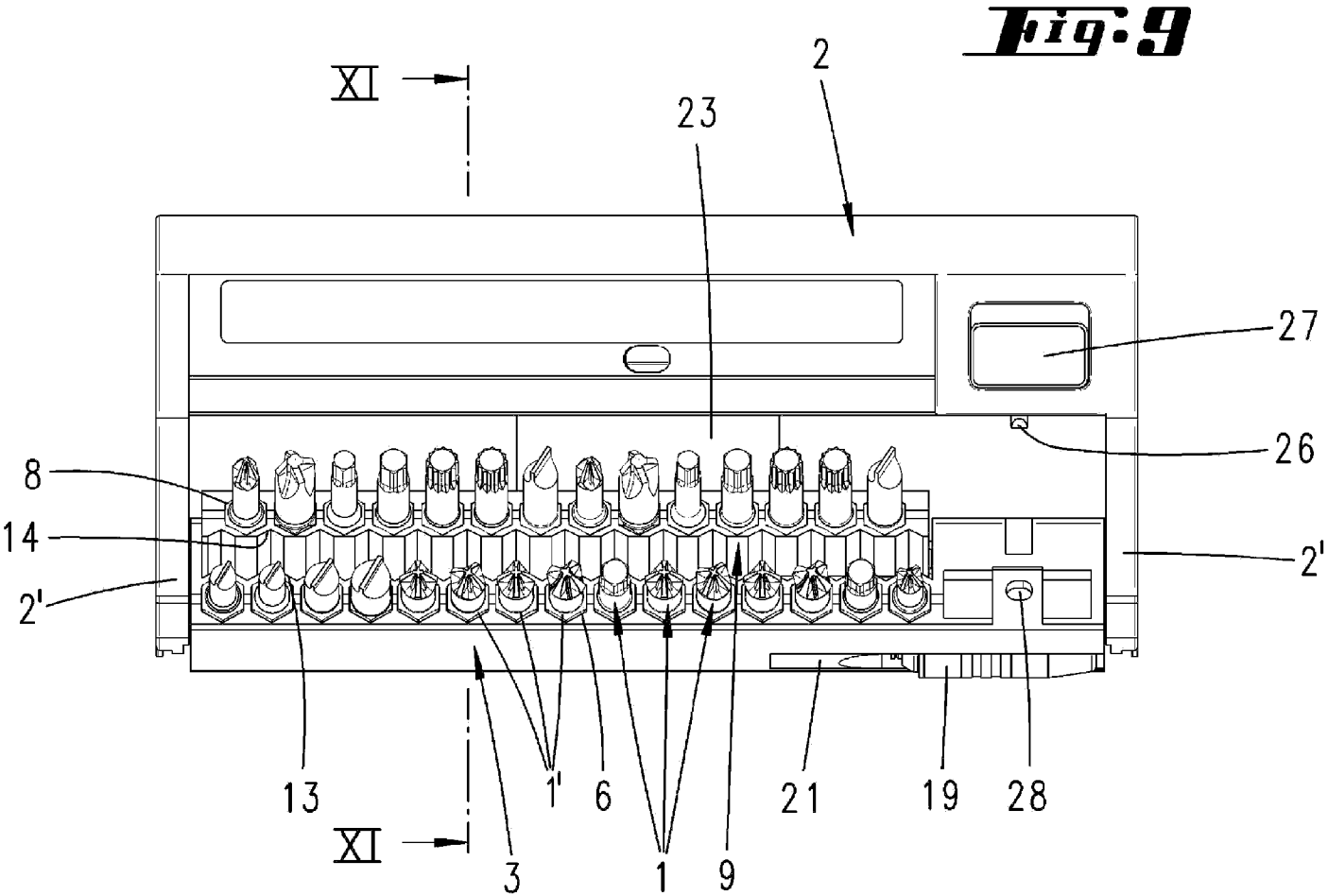
FIG. 9 shows a broad-side view of the device in the removal position.

FIG. 6 describes the arrangement of the retaining openings 6, 8 of the housing pivotable part 3 on the one hand and of the pivotable strip 9 on the other hand in the storage position. It can be seen that in the embodiment the outer wall 14 of the pivotable part 3 is almost contiguous with the outer wall 13 of the pivotable strip 9. The two outer walls 13, 14 thus combine for form abutment faces. The abutment face 13 is situated at a narrow gap distance from the counterabutment 14. In storage position, however, the zigzag-shaped faces 13, 14 interlock with one another. The zigzag protrusion of the one face 13, 14 engages in a zigzag-shaped recess of the other face 13, 14. At the point where the row of retaining openings 6 has an interval space, a bit is positioned at the retaining openings 8. In corresponding manner, where a vacant space is provided between two neighboring bits in the retaining openings 8, a retaining opening 6 is provided at the housing pivotable part 3.

The two zigzag faces 13, 14 are configured in such a way, however, that they can also move into contact with one another. Each zigzag protrusion has a join line on which two faces connect at an angle of 120 degrees. The zigzag recess also has a join line on which two faces run together at a 120 degree angle. The zigzag protrusion's join line lies above the center axis of the bits that are backed up in alignment with it. The zigzag recess's join line is situated in front of a separating stud between two retaining openings 6, 8. In the storage position the join lines of the zigzag protrusions of the one outer wall 13, 14 lie immediately in front of a join line of a zigzag recess of the respective other outer wall 14, 13.

All disclosed characteristics are (in themselves) essential to the invention. The disclosure of the application hereby includes also the disclosed content of the related/appended priority documents (copy of the preliminary application) in their entirety, including for the purposes of including characteristics of these documents in the claims of the present application.

What is claimed is:

1. A storage device for tools, comprising a basic housing piece that is provided with a swiveling-in space for a pivotable part which is hinged to the basic housing piece so as to be pivotable from a storage position, in which the pivotable part is inserted in the swiveling-in space, into a removal position, in which the pivotable part is swiveled out of the swiveling-in space about a swiveling axis, wherein the pivotable part in a first row encompasses retaining openings for tool retaining sections, such that said retaining openings extend into a tool accommodating compartment in the storage position, said tool accommodating compartment adjoining the swiveling-in space and at least one additional row of retaining openings is provided that is parallel to the first row and where the retaining openings of the at least one additional row are associated with a pivotable strip which is contiguous with the pivotable part in the storage position and in the removal position assumes a pivotable distance position from the pivotable part, characterized in that the retaining openings of the first row and the at least one additional row have an outer wall of basically hexagonal-cross-section and are offset relative to one another by gaps, the outer wall of the basically hexagonal-cross-section retaining openings of the pivotable part that face the pivotable strip and the outer wall of the basically hexagonal-cross-section retaining openings of the pivotable strip both extend in a zigzag manner, and zigzag protrusions of the one outer wall engage with zigzag recesses of the other outer wall.

2. The storage device according to claim 1, wherein the pivotable strip is held in an abutment position on the pivotable part by means of an abutment on the basic housing piece.

3. The storage device according to claim 1, wherein the pivotable strip is positioned in a recess of the pivotable part.

4. The storage device according to claim 1, wherein an abutment face of the pivotable part and a counterabutment face configured by the pivotable strip are formed by the respective outer walls.

5. The storage device according to claim 1, wherein the swiveling-in space is open to the front broad side of the basic housing piece and to the rear broad side of the basic housing piece and the broad sides of the closed housing are formed at least in places by the broad sides of the pivotable part.

6. The storage device according to claim 1, wherein the tool accommodating compartment in the storage position has the shape of a five-sided closed hollow space, where one lateral wall of the tool accommodating space is formed by a narrow lateral area of the pivotabte part which forms the retaining opening.

7. The storage device according to claim 1, wherein one abutment face is formed by the outer walls of the retaining openings of the pivotable strip that basically have a hexagonal cross-section and one counterabutment face is formed by an edge area of a closed rear wall of the tool accommodating compartment.

8. The storage device according to claim 1, wherein a swiveling axis of the pivotable strip is about midway between the two longitudinal narrow sides of the pivotable part.

9. The storage device according claim 1, wherein the longitudinal narrow side of the pivotable strip that contains the retaining openings extends beyond the longitudinal narrow side of the pivotable part that contains the retaining openings.

10. The storage device for tools according to claim 1, provided with an accommodating chamber for a casing, said chamber being open to a housing broad side and comprising an insertion opening (20) for an insertion shaft of the casing, where the accommodating chamber on the side opposite the insertion opening is open in the removal position and is closed in the storage position, wherein the axial length of the accommodating chamber with respect to the direction of extension of the insertion shaft is shortened by a filler piece inserted in the accommodating chamber.

11. The storage device according to claim 10, wherein the filler piece forms a partial section of the insertion opening for the insertion shaft.

12. The storage device according to claim 10, wherein the filler piece is secured in place in the accommodating chamber in the manner of a catching form-lock.

13. The storage device according to claim 10, characterized by a catch-arm that is configured to match the filler piece and on its free end forms a catch-hook, which engages by catching behind the housing as far as one catch-stop.

14. The storage device according claim 10, wherein accommodating chamber in the pivotable part and the accommodating chamber wall that closes off the accommodating chamber in the storage position are formed by the basic housing piece.

15. The storage device according to claim 14, wherein the accommodating chamber wall is formed by a U-leg of the U-shaped basic housing piece.

16. The storage device according to claim 14, wherein the insertion opening extends parallel to the swiveling axis of the pivotable part.

17. The storage device according to claim 1, characterized by a belt-holding strap clipped onto the rear broad side of the basic housing piece.

* * * * *